US005711722A

United States Patent [19]

Miyajima et al.

[11] Patent Number: 5,711,722

[45] Date of Patent: Jan. 27, 1998

[54] GOLF CLUB HEAD

[75] Inventors: Tetsuya Miyajima, Tokyo; Hirato Shimasaki; Hiroshi Ezaki, both of Saitama-ken, all of Japan

[73] Assignee: Bridgestone Sports Co., Ltd., Tokyo, Japan

[21] Appl. No.: 707,286

[22] Filed: Sep. 3, 1996

[30] Foreign Application Priority Data

| | | | |
|---|---|---|---|
| Apr. 9, 1995 | [JP] | Japan | 7-250158 |
| Mar. 21, 1996 | [JP] | Japan | 8-091933 |
| Jun. 28, 1996 | [JP] | Japan | 8-188707 |

[51] Int. Cl.[6] ..... A63B 53/04

[52] U.S. Cl. ..... 473/346; 473/350

[58] Field of Search ..... 473/324, 344, 473/346, 349, 350, 329, 332, 330, 331, 345

[56] References Cited

U.S. PATENT DOCUMENTS

| | | | |
|---|---|---|---|
| 572,436 | 12/1896 | Mills | 473/346 |
| 4,214,754 | 7/1980 | Zebelean | 473/346 |
| 4,489,994 | 12/1984 | Kobayashi | 473/346 |
| 4,511,145 | 4/1985 | Schmidt | 473/346 |
| 4,930,781 | 6/1990 | Allen | 473/346 |
| 5,000,454 | 3/1991 | Soda | 473/346 |
| 5,090,702 | 2/1992 | Viste | 473/331 |
| 5,213,328 | 5/1993 | Long | 473/346 |
| 5,362,055 | 11/1994 | Rennie | 473/346 |
| 5,377,985 | 1/1995 | Ohnishi | 473/346 |
| 5,397,126 | 3/1995 | Allen . | |
| 5,401,021 | 3/1995 | Allen . | |

*Primary Examiner*—Sebastiano Passaniti
*Attorney, Agent, or Firm*—Jordan & Hamburg

[57] ABSTRACT

An enlarged golf club head has a front wall decreased in thickness, which is sufficient strength, easy to menufacture, and has no increase in total weight. It is a wood or iron golf club head with a plate wall made of a metal, a front side of which provides a front wall having a ball striking front face and a back face at the opposite side thereof, the back face having a plurality of ridges projecting rearwardly of the back face. The ridges extend vertically, horizontally or in both directions of the club head and are disposed at a back of at least a sweet spot of the front face.

16 Claims, 9 Drawing Sheets

GOLF CLUB HEAD

BACKGROUND OF THE INVENTION

The present invention relates to a wood or iron type golf club head with a plate-like wall made of a metal, a front side of which provides a front wall having a ball striking front face and a back face at the opposite side thereof.

Wood or iron type golf club heads with a plate-like wall made of a metal, the front side of which provides a front wall having a ball striking front face and a back face at the opposite side thereof (the plate-like metal wall will also be referred to as "front wall" hereinafter), generally include ones wholly made of a metal, and so-called composite ones made of a fiber-reinforced plastic except for the front wall thereof. In all such golf club heads, the front wall is required to be strong enough to withstand impacts repeatedly occuring when striking golf balls. The front wall made of a stainless steel, for example, SUS630, by casting, must be at least 3 mm thick to have such sufficient strength. The front wall as a whole has a uniform thickness. If the surface area of the front wall is increased, the golf club head will have a correspondingly increased weight.

Typical golf club heads in which the front wall has the whole thickness reduced and yet retains a sufficient strength, while having the surface area increased, are known from the disclosure in the U.S. Pat. Nos. 5,897,126 and 5,401,201. In these golf club heads, the front wall has integral ribs on the entire rear or back surface thereof and extending rearwardly therefrom. These ribs form a plurality of cellular honeycomb structures, namely, a honeycomb network which reinforces and stiffens the front wall. All the unit cells of the honeycomb network are hexagons identical in size to each other.

To assure a sufficient strength of the front wall, the conventional front wall, of which the thickness is uniform, must be wholly thickned. To enlarge the golf club head, the front wall has to be lighter. Thus, such club heads have been proposed as disclosed in the United States Patents. However, if the size of the unit cells of the honeycomb network, that is, the size of hexagon, is large, the front wall does not have sufficient strength when the front wall is 1 mm thick. If the hexagon size is decreased to assure a sufficient strength of the front wall, the honeycomb network will have an increased weight. Namely, even if the front wall is reduced in thickness, the total weight of the honeycomb network and front wall will not be smaller than that of a conventional striking face wall of 3 mm in thickness. Also, if the hexagon size of the honeycomb network is small in case the honeycomb network and front wall are formed by casting in a manufacturing process, the molten metal will not flow smoothly during casting in a specific mold, resulting in unacceptable products.

SUMMARY OF THE PRESENT INVENTION

Accordingly, the present invention has an object to provide an enlarged golf club head with a front wall decreased in thickness while retaining sufficient strength, which is easy to manufacture, and does not increase a total weight thereof.

The above object is accomplished by providing a wood or iron golf club head with a plate-like wall made of a metal, a front side of which provides a front wall having a ball striking front face and a back face at the opposite side thereof, the back face having a plurality of ridges projecting rearwardly from the back face, the ridges extending vertically, horizontally or in both directions of the club head and which are disposed at a back of at least a sweet area of the front face.

Due to the configuration according to the present invention, an enlarged golf club head can be formed to have a sufficiently strong and lightweight front wall.

These objects and other objects, features, aspects and advantages of the present invention will become more apparent from the following detailed description of the present invention when taken in conjunction with the accopanying drawings.

DETAILED DESCRIPTION OF THE INVENTION

Figure 1:
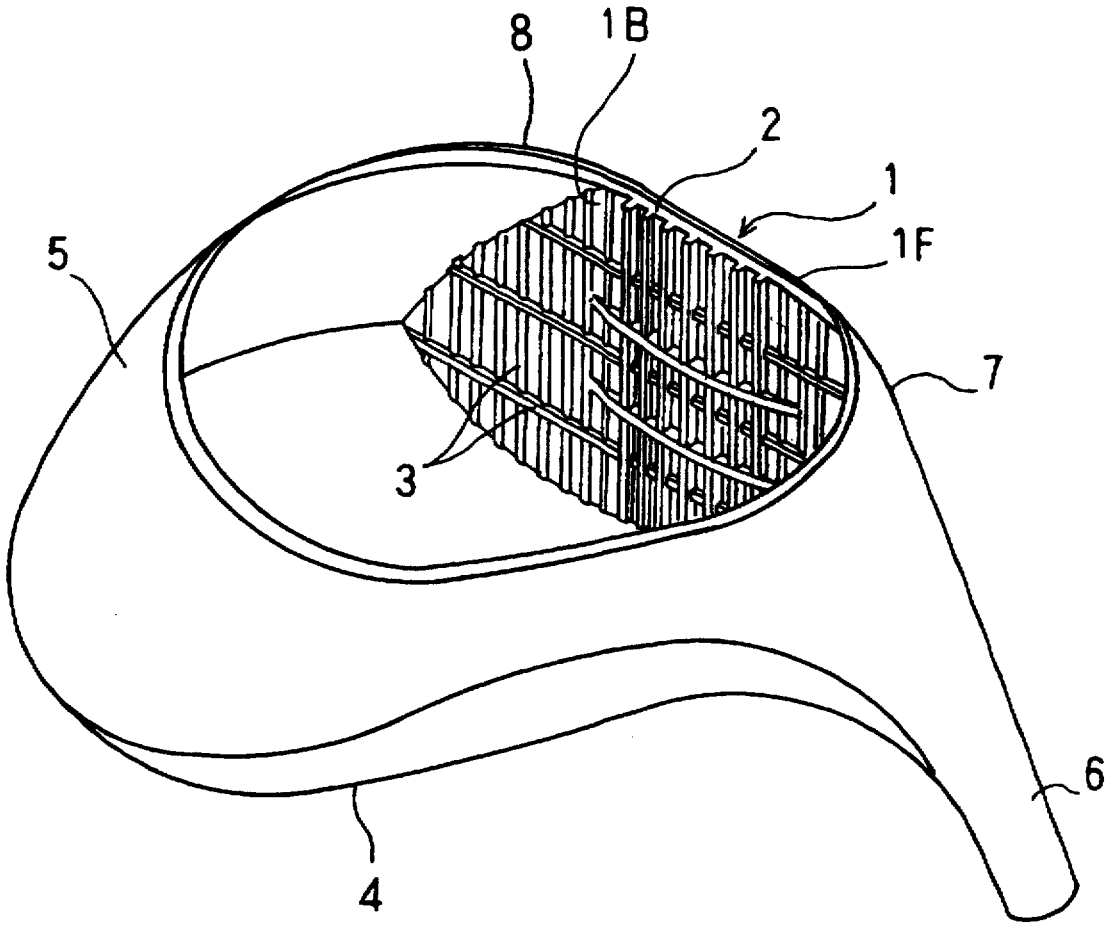
FIG. 1 is a perspective view of a wood golf club head according to a first embodiment of the present invention, showing the head inside with the sole wall removed.
Figure 2:
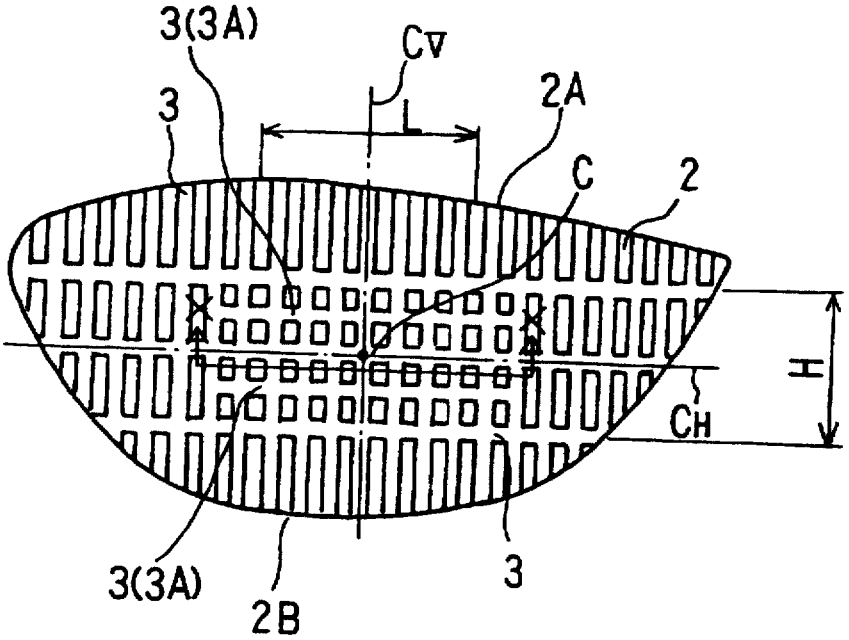
FIG. 2 is a rear plan view of the front wall of the first embodiment shown in FIG. 1.
Figure 3:
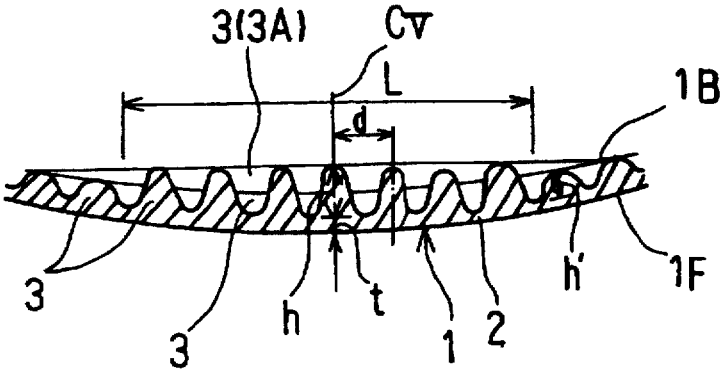
FIG. 3 is a sectional view taken along the line X—X of FIG. 2.

Referring to FIGS. 1 to 3, a wood golf club head according to the first embodiment of the present invention will be described below. FIG. 1 is a perspective view showing the head inside with a sole wall removed. The golf club head has a front wall 1 which is a front side of a metal plate 2. The front wall 1 has a ball striking front face 1F and a back face 1B at the opposite side thereof. The back face 1B has formed integrally therewith a plurality of ridges 3 projecting rearwardly thereof. The golf club head has also a crowned top wall 4, perimeter wall 5 and hosel 6. A portion of the front wall 1 which is on the side of the hosel 6 is called a "heel 7" while a portion of the front wall 1 opposite to the heel wall is called a "toe 8".

FIG. 2 is a rear plan view of the front wall 1 of which the front side provides the ball striking front face 1F. According to this embodiment, the ridges 3 extend both vertically (in the direction from a top wall 2A toward a sole wall 2B) and horizontally of the club head. The ridges 3 are formed more densely per unit area in a back of a central area containing a sweet area of the ball striking front face 1F than in a back of a peripheral area. Namely, the ridges 3 formed in the central area of the front wall 1 include two additional horizontal ridges 3A as apparent from FIGS. 1 and 2. A center of the front wall 1, namely, face center, is indicated with C. The central area is defined by a length L extending horizontally and a height H extending vertically, both the length and height passing through the face center C. The length L and height H are both within a range of 20 to 35 mm. That is to say, a hitting area of the front face 1F always lies in the central area. The sweet area also lies in the central area.

FIG. 3 is a sectional view taken along the line X—X of FIG. 2. According to this embodiment, each height h to h' of the ridges 3 is such that the height h' of the ridges 3 positioned at opposite extremities of the central area is the smallest and the ridges 3 are increasingly higher, proceeding from the upper and lower, and right and left extremities of the central area toward the face center C, as shown in FIG. 3. As seen, the height h of the ridge 3 at the face center C is the greatest. A thickness t of the front wall 1 is 1 mm. The heighth h and h' of the ridges 3 are in a range of 1 to 5 mm, and should preferably be 2 to 4 mm. A spacing d between the ridges 3 is 2 to 10 mm, and should preferably be 2 to 5 mm. Also, the ridges 3 are formed to be parallel with both a vertical plane Cv and a horizontal plane $C_H$ both containing the face center C and perpendicular to the striking face wall 2. However, the vertical ridges 3 may be somewhat oblique with respect to the plane Cv, and also, the horizontal ridges 3 may be somewhat oblique with respect to the plane $C_H$. The vertical ridges 3 are substatially parallel with each other, and also, the horizontal ridges 3 are substantially parallel with each other. As illustrated, the ridges 3 are designed to have a sectional form of a waveform, that is, a repetition of circular convexities and concavities. However, each ridge may be formed to have a trapezoidal, triangular or rectangular sectional shape.

The front wall 1 has a unifrom thickness t vertically and horizontally nearly over the entirety thereof. However, the front wall 1 my be increased in the thickness t in the central area thereof and reduced in the peripheral area.

The entirety, except for the sole wall (not shown), of the wood golf club head accroding to the first embodiment of the present invention shown in FIGS. 1 to 3 can be easily made by a precision casting, for example, the lost wax process.

Figure 4:
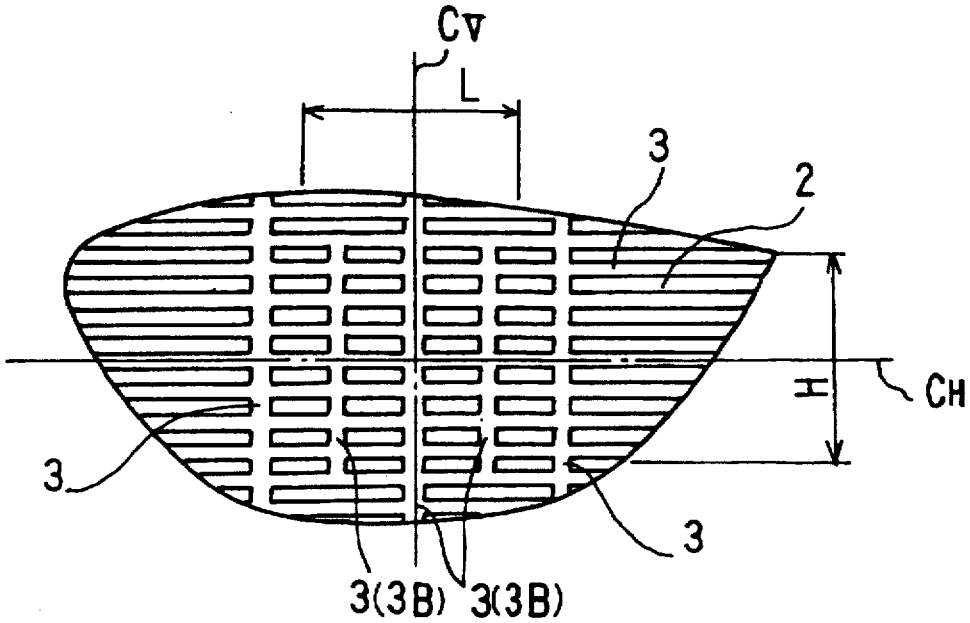
FIG. 4 is a rear plan view similar to FIG. 2, of a wood golf club head according to a second embodiment of the present invention.

FIG. 4 shows another embodiment of the present invention. As shown, the ridges 3 are formed in different positions from in the first embodiment. There are formed horizontal ridges 3 and one vertical ridge 3 which passes through the face center C. Two more vertical ridges 3 are formed symmetrically with respect to the vertical ridge 3 passing through the face center C. Namely, three vertical ridges 3 are provided within the central area. They are indicated by reference designator 3B.

In the first and second embodiments of the present invention shown in FIGS. 1 to 4, the front wall 1 and ridges 3 are integrally formed from, for example, a stainless steel by casting. The thickness t of the front wall 1 is 1 mm, length L is 25 mm, height h of the highest ridge is 4 mm, and height h' of the lowest ridge 3 is 2 mm. In FIG. 2, the ridges 3 are spaced 4 mm from each other in the central area, and the largest inter-ridge spacing (vertical spacing) is 10 mm.

Figure 5:
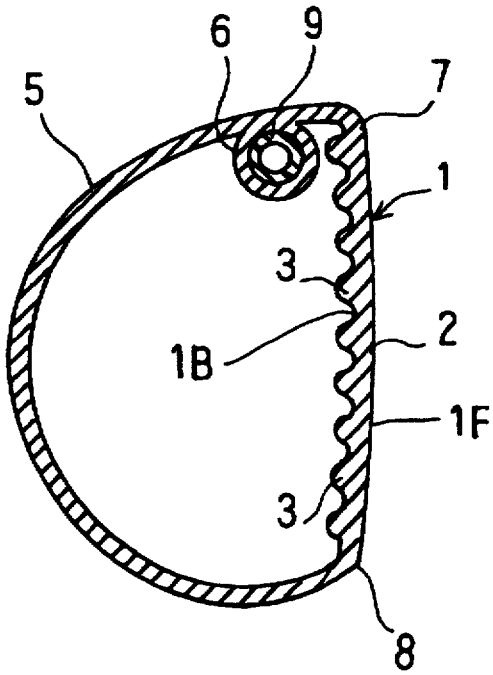
FIG. 5 is a horizontal sectional view of the front wall of wood golf club head accroding to a third embodiment of the present invention.
Figure 6:
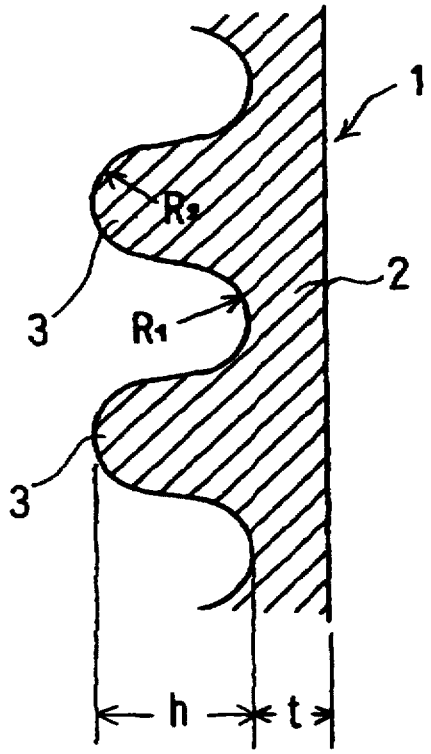
FIG. 6 is a sectional view, enlarged in scale, of the front wall having the ridges formed integrally on the rear side thereof.

FIG. 5 shows the third embodiment of the present invention. The golf club head according to this embodiment has only vertical ridges formed on the back face 1B of the front wall 1 thereof. The horizontal section of these ridges 3 has the shape of waveform. Also, the hosel 6 has a shaft 9 inserted and secured therein. FIG. 6 is a sectional view, enlarged in scale, of the ridges 3. The front wall 1 and ridges 3 may be integrally formed from a metal such as stainless steel, titanium or titanium alloy, or aluminum or aluminum alloy. A radius of curvature $R_1$ of the concavity between the ridges 3 is 0.5 to 1 mm, and it should preferably be 0.75 mm. Similarly, a radius of curvature $R_2$ of the circular end of the ridge 3 is 0.5 to 1 mm, and it should preferably be 0.75 mm. When the thickness t of the front wall 1 is 1.0 mm and height h of the ridges 3 is 2 mm, the weight of the golf club head according to the present invention is ⅔ that of a conventional golf club head of which the front wall is 3 mm thick. This weight reduction can be an advantage for providing an enlarged golf club head.

Figure 7:
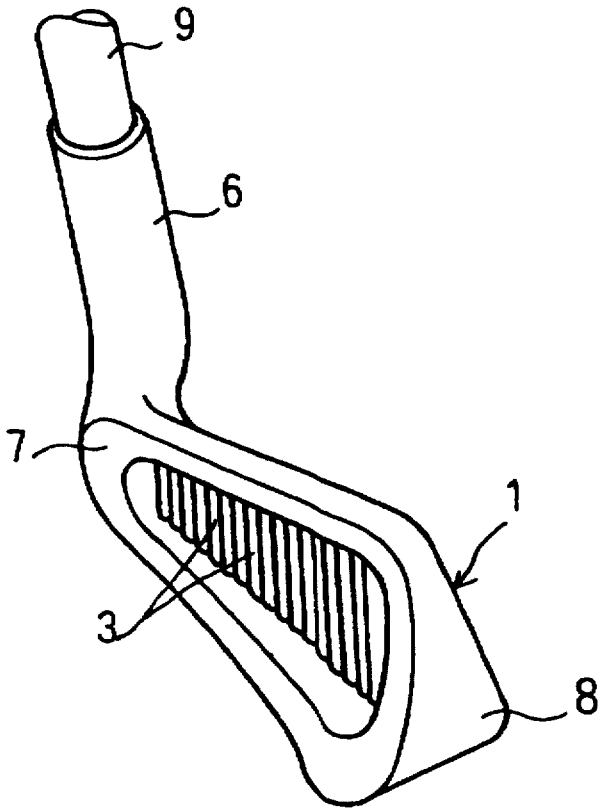
FIG. 7 is a perspective view of an iron golf club head according to a four embodiment of the present invention.

FIG. 7 is a perspective of an iron golf club head according to the fourth embodiment of the present invention. The front wall 1 has formed integrally on a rear side thereof a plurality of similar ridges 3 to those shown in FIG. 5. This iron golf club head has a cavity formed in a back face thereof. Namely, it is of a so-called "cavity-backed type". The thickness of the front wall 1 is minimized, and the material available because of the thickness reduction can be redistributed to a perimeter of the cavity, or used to enlarge the head itself, in order to widen the sweet area of the club head. The weight of the material removed for the cavity may be redistributed to a wall of the heel 7 and a wall of toe 8 to increase a moment of inertia of the golf club head.

According to the third and fourth embodiments, all the top wall, front wall, toe and heel walls, and sole wall are integrally formed from a same material. However, the head portions except for the front wall 1 and ridges 3 may be formed from a fiber-reinforced plastic or different materials.

Figure 8:
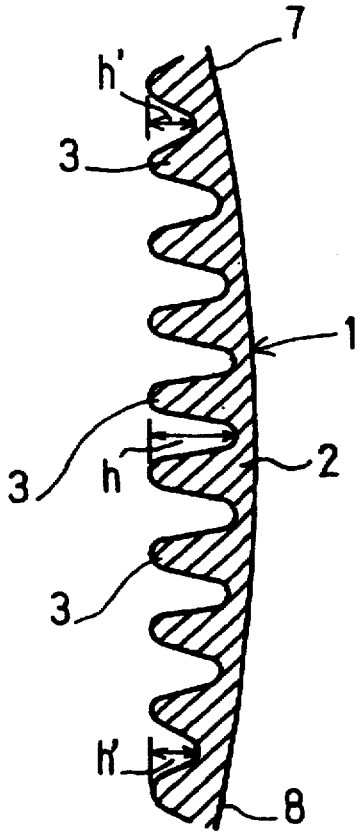
FIG. 8 is a sectional view, enlarged in scale, of the front wall of a golf club head accroding to a fifth embodiment of the present invention and which has ridges fromed on the rear side thereof.

FIG. 8 shows the fifth embodiment of the present invention. In this embodiment, the height h' to h of the ridges 3 are increasingly greater proceeding toward the face center C. The heighth is approximately 2.3 times larger than the height h'.

Figure 9:
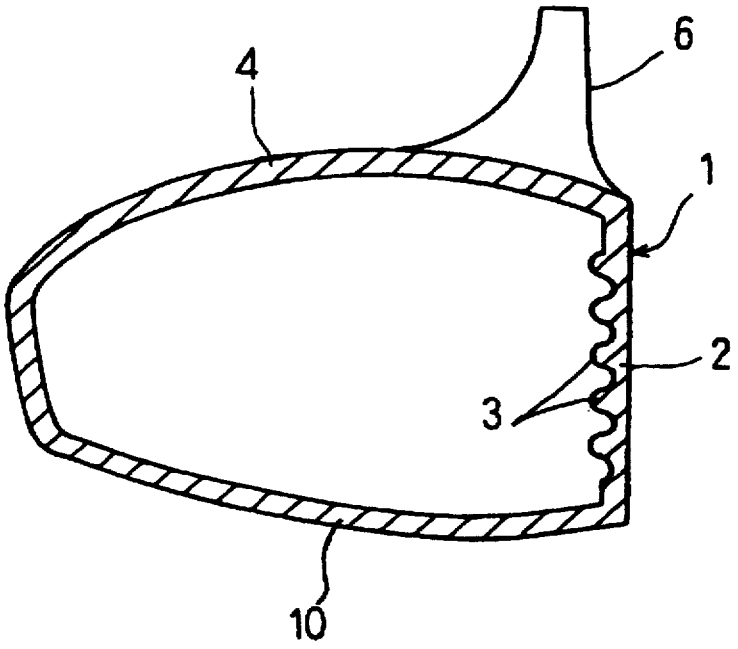
FIG. 9 is a vertical sectional view of a wood golf club head accroding to a sixth embodiment of the present invention.
Figure 10:
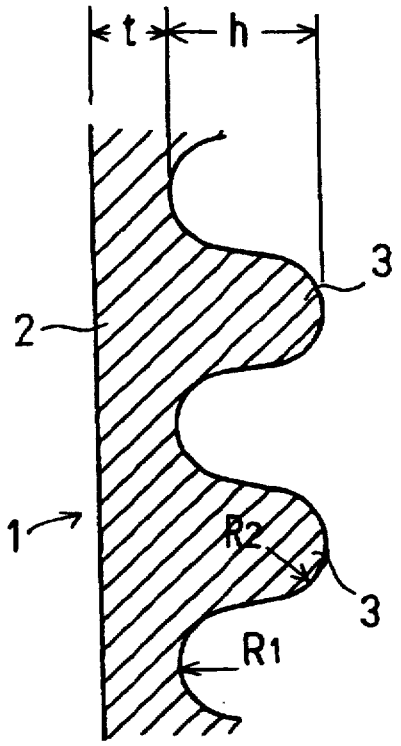
FIG. 10 is a sectional view, enlarged in scale, of the front wall of the sixth embodiment in FIG. 9 and having the ridges formed integrally on the rear side thereof.

FIG. 9 shows a wood golf club head according to the sixth embodiment of the present invention. The front wall 1 has formed integrally on the rear side thereof a plurality of ridges 3 extending horizontally and in substantially parallel with each other. FIG. 10 is a sectional view, enlarged in scale, of the ridges 3. The radius of curvature $R_1$ of the concavity between the ridges 3 is 0.5 to 1 mm, and it should preferably be 0.75 mm. Similarly, the radius of curvature $R_2$ of the circular end of the ridge 3 is 0.5 to 1 mm, and it should preferably be 0.75 mm. The ridges 3 have a height h of 2 mm and the front wall 1 has a thickness t of 1 mm. Also in this embodiment, the ridges 3 may be gradually higher proceeding toward the face center C.

Figure 11:
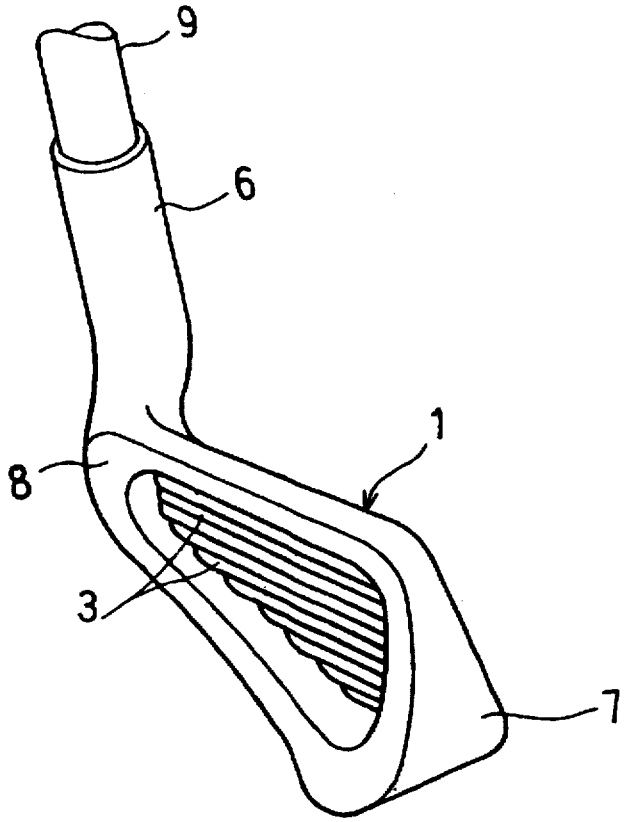
FIG. 11 is a perspective view of an iron golf club head according to a seventh embodiment of the present invention.

FIG. 11 is a perspective view of an iron golf club head according to the seventh embodiment of the present invention, in which the front wall 1 has formed on the rear side thereof a plurality of ridges 3 extending horizontally and in parallel with each other.

The third embodiment having been illustrated and described with reference to FIG. 5, in which the ridges 3 are formed only in the vertical direction on the rear side of the front wall 1, may have additionally formed on the rear side of the front wall 1 at least one ridge extending horizontally and passing through the face center C.

Note that in the foregoing, the "sweet area" of a golf club head refers to an area where such hitting points are concentrated as, under the assumption that the desingned maximum flying distance of a ball struck by the golf club head is 100% will enable more than 90% of the maximum flying distance. The "impact area is an area at which a golf ball is frequently hit. The ridges 3 are disposed at a back of at least the sweet area of the front face 1F.

What is claimed is:

1. A wood or iron golf club head comprising:

a plate wall made of a metal having a front face for striking a ball and a back face opposite said front face;

said back face having a plurality of ridges projecting rearwardly from the back face;

said ridges including one of vertical ridges, horizontal ridges and both vertical and horizontal ridges;

said ridges being disposed at least in an area behind a sweet spot area of the front face;

said ridges having top portions which are semicircular in cross section and said ridges defining troughs therebetween with said troughs having bottoms which are semicircular in cross section such that said ridges define circular convexities and circular concavities; and said ridges having a height in a range of 1 to 5 mm and said ridges being spaced at intervals in a range of 2 to 10 mm.

2. A golf club head according to claim 1, wherein said ridges are formed higher in a central area of said back face than in an area surrounding the central area.

3. A golf club head according to claim 2, wherein said ridges are formed more densely in said central area.

4. A golf club head according to claim 1, wherein said metal is one of stainless steel, titanium, titanium alloy, aluminum and aluminum alloy.

5. A golf club head according to claim 1, wherein said ridges are formed more densely in a central area of said back face than in an area surrounding the central area.

6. A golf club head according to claim 1, wherein said plate wall has a thickness of 1 mm exclusive of said height of said ridges.

7. A wood or iron golf club head comprising:

a plate wall made of a metal having a front face for striking a ball and a back face opposite said front face;

said back face having a plurality of ridges projecting rearwardly from the back face;

said ridges including one of horizontal ridges and both vertical and horizontal ridges;

said ridges being disposed in a central area behind a sweet spot area of the front face and in a surrounding area surrounding said central area;

at least one of said horizontal ridges extending through both said central area and said surrounding area; and said central area including additional ones of said horizontal ridges, which are limited to said central area, resulting in a horizontal ridge density of said central area being greater than a horizontal ridge density of said surrounding area.

8. A golf club head according to claim 7, wherein said ridges have top portions which are semicircular in cross section and said ridges define troughs therebetween with said troughs having bottoms which are semicircular in cross section such that said ridges define circular convexities and circular concavities.

9. A golf club head according to claim 7, wherein said metal is one of stainless steel, titanium, titanium alloy, aluminum and aluminum alloy.

10. A wood or iron golf club head comprising:

a plate wall made of a metal having a front face for striking a ball and a back face opposite said front face;

said back face having a plurality of ridges projecting rearwardly from the back face;

said ridges including one of vertical ridges and both vertical and horizontal ridges;

said ridges being disposed in a central area behind a sweet spot area of the front face and in a surrounding area surrounding said central area;

at least one of said vertical ridges extending through both said central area and said surrounding area; and said central area including additional ones of said vertical ridges, which are limited to said central area, resulting in a vertical ridge density of said central area being greater than a vertical ridge density of said surrounding area.

11. A golf club head according to claim 10, wherein said ridges have top portions which are semicircular in cross section and said ridges define troughs therebetween with said troughs having bottoms which are semicircular in cross section such that said ridges define circular convexities and circular concavities.

12. A golf club head according to claim 10, wherein said metal is one of stainless steel, titanium, titanium alloy, aluminum and aluminum alloy.

13. A wood or iron golf club head comprising:

a plate wall made of a metal having a front face for striking a ball and a back face opposite said front face;

said back face having a plurality of ridges projecting rearwardly from the back face;

said ridges including one of horizontal ridges, vertical ridges and both vertical and horizontal ridges;

said ridges being disposed at least in a central area behind a sweet spot area of the front face; and ones of said ridges in said central area having heights increasing in reverse relation to a distance from a center of said central area.

14. A golf club head according to claim 13, wherein said ridges have top portions which are semicircular in cross section and said ridges define troughs therebetween with said troughs having bottoms which are semicircular in cross section such that said ridges define circular convexities and circular concavities.

15. A golf club head according to claim 13, wherein said metal is one of stainless steel, titanium, titanium alloy, aluminum and aluminum alloy.

16. A wood or iron golf club head comprising:

a plate wall made of a metal having a front face for striking a ball and a back face opposite said front face;

said back face having a plurality of ridges projecting rearwardly from the back face;

said ridges including one of vertical ridges, horizontal ridges and both vertical and horizontal ridges;

said ridges being disposed in at least a central area behind a sweet spot area of the front face; and said ridges having top portions which are semicircular in cross section and said ridges defining troughs therebetween with said troughs having bottoms which are semicircular in cross section such that said ridges define circular convexities and circular concavities.

* * * * *